US005491865A

United States Patent [19]

Gueret

[11] Patent Number: 5,491,865

[45] Date of Patent: Feb. 20, 1996

[54] BRUSH FOR THE APPLICATION OF NAIL VARNISH OR A SIMILAR PRODUCT

[75] Inventor: Jean-Louis H. Gueret, Paris, France

[73] Assignee: L'Oreal, Paris, France

[21] Appl. No.: 282,471

[22] Filed: Jul. 29, 1994

Related U.S. Application Data

[63] Continuation-in-part of Ser. No. 13,737, Feb. 4, 1993, Pat. No. 5,357,647.

[30] Foreign Application Priority Data

Feb. 11, 1992 [FR] France ..... 92 01498

[51] Int. Cl.[6] ..... A46B 9/00

[52] U.S. Cl. ..... 15/159.1; 15/160; 15/207.2; 15/DIG. 6

[58] Field of Search ..... 15/159.1, 167.3, 15/207.2, 160, DIG. 6, 167.1; 401/129; 132/218, 317, 320

[56] References Cited

U.S. PATENT DOCUMENTS

| | | | |
|---|---|---|---|
| 3,153,800 | 10/1964 | Trotin | 15/207.2 |
| 3,186,018 | 6/1965 | Shaw | 15/159.1 |
| 3,263,258 | 8/1966 | Burge | 15/167.1 |
| 3,668,732 | 6/1972 | Lardenois | 15/207.2 |
| 4,861,179 | 8/1989 | Schrepf | 15/207.2 |
| 4,927,281 | 5/1990 | Gueret | 15/207.2 |
| 4,958,402 | 9/1990 | Weihrauch | 15/207.2 |
| 5,161,554 | 11/1992 | Fitjer | 15/159.1 |

*Primary Examiner*—David Scherbel
*Assistant Examiner*—Terrence R. Till
*Attorney, Agent, or Firm*—Cushman Darby & Cushman

[57] ABSTRACT

The brush comprises a group of larger bristles having two subgroups of differently sized bristles and a group of smaller bristles having two subgroups of different sizes. The proportion of larger bristles being between 2% and 95% by volume in relation to the total volume of the tuft of the brush.

21 Claims, 3 Drawing Sheets

BRUSH FOR THE APPLICATION OF NAIL VARNISH OR A SIMILAR PRODUCT

CROSS REFERENCE TO RELATED APPLICATION

This is a continuation-in-part of application Ser. No. 013,737, filed Feb. 4, 1993 now U.S. Pat. No. 5,357,647.

FIELD OF THE INVENTION

The invention relates to a brush for the application of nail varnish or a similar product, of the type comprising bristles disposed substantially parallel to one another in a tuft and fixed to a support.

BACKGROUND OF THE INVENTION

The brushes proposed hitherto generally ensure relatively satisfactory making up, but it is desirable to be able to improve the precision and speed of making up, especially the precision of the application of nail varnish or a similar product.

Moreover, with a conventional brush, the brush often has to be dipped into the container several times in order to make up a nail as the product load taken up by the brush is relatively light. Various solutions have already been proposed to obviate this disadvantage and to incorporate a sort of storage tank into the shaft of the brush, but these solutions complicate the manufacture and use of the brush.

The aim of the invention is above all to provide a brush which no longer displays, or displays to a lesser extent, the abovementioned disadvantages and which allows for precise, rapid making up.

SUMMARY OF THE INVENTION

According to the invention, a brush for the application of nail varnish or a similar product, comprising bristles disposed substantially parallel to one another in a tuft and fixed to a support is characterised in that the bristles are formed by a mixture of bristles of small section, or small bristles, and bristles having a larger cross section, or large bristles, the proportion of large bristles being between 2% and 95% by volume in relation to the total volume of the tuft of the brush, and preferably between 10% and 90%, the large bristles including at least two groups of bristles with cross sections of different sizes, the sizes of the sections of the large bristles within one single group being substantially constant.

The small bristles preferably have a section inscribed in a circle having a diameter of between 4 hundredths and 10 hundredths of a millimeter, while the large bristles have a section inscribed in a circle having a diameter of between 10 hundredths and 40 hundredths of a millimeter. The section of the large bristles is advantageously inscribed in a circle having a diameter of between 14 hundredths and 17 hundredths of a millimeter.

The small bristles may comprise at least two groups of bristles with cross sections of different sizes, the sizes of the sections of the small bristles of one single group being substantially constant.

The difference between the diameters of the circles circumscribed about the sections of two groups of bristles with sections of different sizes is advantageously at least 2 hundredths of a millimeter.

The length of the tuft of bristles is generally between 11 and 25 mm, and in particular between 13 and 20 mm. The large bristles and the small bristles may have the same length. As a variant, they may not have the same length, the difference in length then being between 0.1 and 2 mm.

By virtue of the presence of the large bristles, it is possible to produce longer tufts, greater than 13 mm, so that upon application it is possible to obtain different curvatures of the brush from those of a normal brush, the tuft length of which is between 11 and 13 mm. This facilitates the application of the varnish and increases its performance.

When the bristles are made of plastic or natural material, the material forming the bristles is advantageously selected from the group formed by polyamides, polyesters, polyether block amides, polyethylene, polytetrafluoroethylene, polyvinylidene fluoride, polyacetals and natural silks, preferably of animal origin.

When the bristles consist of a polyamide, the latter is advantageously selected from the group of polyamides 6, 6-6, 6-10, 6-12 or 11.

If the brush is intended for the application of a nail varnish or a similar product having a low viscosity, especially a viscosity lower than 0.6 Pa s, corresponding to a liquid formulation, the mixture of bristles of the brunch includes approximately 90 to 95% by volume of large bristles in the tuft in order to ensure a sufficient storage effect.

In the case of a brush in which the bristles are made of plastic, an agent improving the sliding properties of the bristle and reducing its absorptivity with respect to water and/or solvent is advantageously incorporated into the material of the bristles, in a proportion of between 0.2% and 15% by weight.

This sliding agent is preferably selected from the group formed by polytetrafluoroethylene, boron nitride and molybdenum disulphide.

At least some of the bristles may have slight undulations over their length.

The bristles may have sections the shape of which is selected from the group of shapes consisting of circular, polygonal, cross-shaped, annular, flat or U-shaped. The bristles may have at least one capillary groove.

The ends of the bristles may be designed as pin-heads, especially obtained by heat treatment.

The ends may also be subjected to an abrasive treatment, e.g. grinding.

The cross section of the brush may have different shapes, inter alia, flat, circular, or may be in the shape of a semi-circular tile so that it corresponds better in shape to the bulb of the nail.

The end of the brush may be flat or rounded.

The bristles are fixed to the shaft with the aid of a hook with either a circular section having a diameter of between 0.5 and 1.5 mm or a rectangular section having dimensions 1.5×0.2 mm.

The end of the shaft to which the tuft of bristles is fixed may have a cone-shaped edge to allow the bristles to move apart from one another.

BRIEF DESCRIPTION OF THE DRAWINGS

In addition to the arrangements described hereinabove, the invention consists of a number of other arrangements which will be described in more detail hereinafter by way of embodiments which are by no means limiting and which are described with reference to the accompanying drawings, in which.

DETAILED DESCRIPTION OF THE INVENTION

Figure 1:
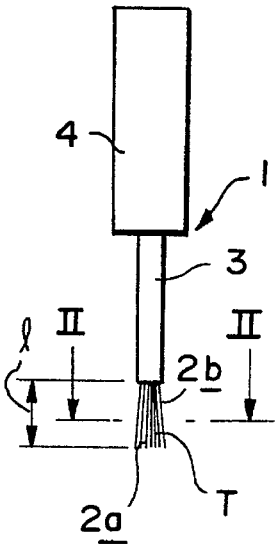
FIG. 1 is a simplified elevation of a brush according to the invention.

Referring to FIG. 1 of the drawings, it shows a brush 1 for the application of nail varnish, comprising bristles 2*a*, 2*b* disposed substantially parallel to one another in a tuft and fixed to a support formed by a shaft 3. The tuft of the bristles 2*a*, 2*b* is fixed to the lower end of the shaft 3, the axis of which is substantially parallel to the bristles of the tuft. The shaft 3 is integral at its other end with a cylindrical sleeve 4 serving as a control member for the brush and as a stopper intended, e.g. to be screwed by virtue of an internal thread not visible in FIG. 1 on to the neck of a varnish bottle.

Although the brush shown shows bristles 2*a*, 2*b* pointing in the longitudinal direction of the support formed by the shaft 3, it is clear that the invention also applies to a brush in which the bristles are fixed in a direction substantially perpendicular to the principal direction of the support.

According to the invention, the bristles of the brush are formed by a mixture of bristles 2*a* of small section, or small bristles, and bristles 2*b* having a larger cross section, or large bristles, the proportion of the large bristles being between 2% and 95% by volume in relation to the total volume of the tuft T of the brush. The mixture of the bristles 2*a*, 2*b* may be statistical or may be according to a predetermined geometric arrangement of the bristles 2*b*, e.g. distributed in a ring.

The cross sections of the small bristles 2*a* are generally inscribed in a circle having a diameter of between 4 hundredths and 10 hundredths of a millimeter, while the sections of the large bristles 2*b* are generally inscribed in a circle having a diameter of between 10 hundredths and 40 hundredths of a millimeter. The sections of the large bristles are preferably inscribed in a circle having a diameter of between 14 hundredths and 17 hundredths of a millimeter.

Figure 3:
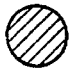
FIGS. 3 to 7 show various possible shapes for the cross sections of the bristles of the brush on a larger scale.
Figure 4:
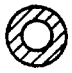
Figure 5:
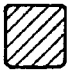
Figure 6:
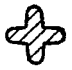
Figure 7:
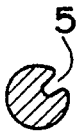

The sections of the bristles 2*a*, 2*b* may have variable shapes. They may be solid circular, as shown in FIG. 3, or hollow circular, as shown in FIG. 4, or polygonal, in particular square, as shown in FIG. 5, or cross-shaped (FIG. 6), circular with a capillary groove 5, as shown in FIG. 7, or U-shaped. The useful length 1 of the tuft of bristles T is between 11 and 25 mm, and preferably between 13 and 20 mm. The large bristles 2*b* have the same length as the small bristles 2*a*.

Figure 2:
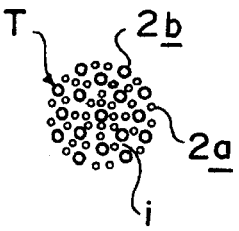
FIG. 2 is a simplified cross section on a larger scale along the line II—II of FIG. 1.

By virtue of the presence of large bristles 2*b*, as can be seen in FIG. 2, the spaces i between the bristles are larger and serve as a capillary store for the product to be applied. This makes it possible to obtain a brush 1 more loaded with product in its tuft T when this tuft has been dipped into the supply of liquid product. The small bristles 2*a* have a "smoothing" function for perfect finishing.

Depending on the viscosity of the liquid product to be applied, the storage effect of the tuft T of bristles of the brush can be controlled by varying the proportion of large bristles 2*b*. E.g. in the case of a liquid nail varnish formulation having relatively low viscosity, e.g. of the order of 0.2 Pa s, the tuft T will contain large bristles 2*b* to approximately 90 to 95% by volume of the tuft.

Figure 8:
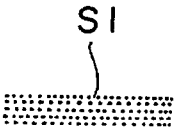
FIGS. 8, 9 and 10 show various possible shapes for the cross section of the tuft of the brush.
Figure 9:
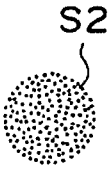
Figure 10:
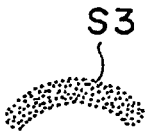

The brush 1 may have different cross-sectional shapes at its tuft T. According to FIG. 8, the cross section S1 of the tuft T is flat, of substantially rectangular shape. According to FIG. 9, the section S2 is circular as in FIG. 2. According to FIG. 10, the tuft T has a cross section S3 in the shape of a semi-circular tile so that it corresponds better in shape to the bulb of the nail.

Figure 11:
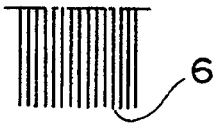
FIGS. 11 and 12 are elevations on a larger scale of two possible shapes for the end of the brush.
Figure 12:
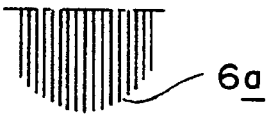

The end 6 of the tuft T may be flat, i.e. rectilinear transversely, as shown in FIG. 11, or may be rounded, as shown by the end 6*a* in FIG. 12. As a variant, the end of the brush may be tapered by abrasion.

Figure 13:
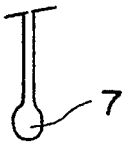
FIG. 13 shows the end of a bristle designed as a pin-head on a larger scale.

The ends of the bristles, in particular the large bristles 2*a*, may have the shape of a bulge 7, like a pin-head, as shown in FIG. 13, obtained, e.g. by heat treatment.

Figure 14:
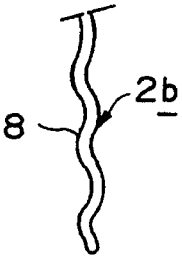
FIG. 14 shows a bristle having slight undulation.

As shown in FIG. 14 for a large bristle 2*b*, the small or large bristles may not be rectilinear over their entire length and may have slight undulations 8 at least over part of their length.

Figure 15:
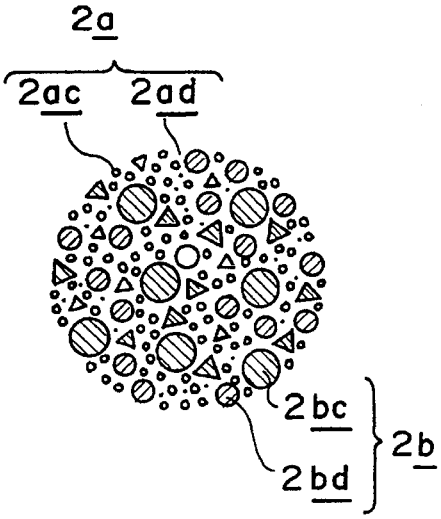
FIG. 15 is a diagrammatic cross section on a larger scale of a variant embodiment of a brush according to the invention.

FIG. 15 is a section showing a variant embodiment of a brush according to the invention.

The large bristles 2*b* include at least two groups of bristles with cross sections of different sizes. The largest bristles are designated 2*bc*, while the slightly smaller bristles are designated 2*bd*. The sizes of the sections of the large bristles within one single group are substantially constant. All of the bristles 2*bc* therefore have a substantially identical section, the same thing applying to the bristles 2*bd*.

The small bristles 2*a* may also comprise at least two groups of bristles 2*ac*, 2*ad* with cross sections of different sizes. The sizes of the sections within one single group 2*a* or 2*ad* are substantially constant.

The brush may thus include at least three groups of bristles the sections of which (for each group) are inscribed in circles having different diameters. The number of groups of bristles may be four, five or more.

The difference between the diameters of the circles circumscribed about the sections of the bristles of two groups is at least 2/100 mm (two hundredths of a millimeter).

The following results are obtained with a brush including at least three groups of bristles with different sections:

- the flow of air and of the product is more gradual in view of the bristles of intermediate section situated between the largest bristles and the smallest bristles;
- intermediate suppleness between that of the smallest, very soft bristle and that of the largest, relatively hard bristle is ensured upon application;

reduction of the difference between the section (and the diameter of the circumscribed circle) of the largest bristles and the smallest bristles.

Figure 16:
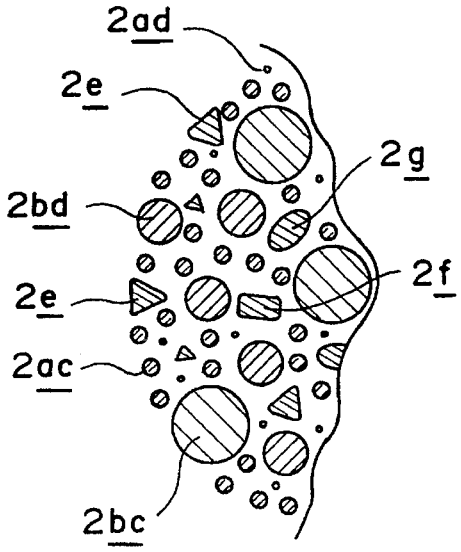
FIG. 16 is an enlarged detail of a zone of FIG. 15.

As can be seen more clearly in FIG. 16, the tuft of the brush of FIG. 15 includes bristles having non-cylindrical sections, e.g. bristles 2*e* with a substantially curvilinear triangular section, bristles 2*f* with a substantially square or rectangular section, or bristles 2*g* with an oval section. These bristles having non-circular sections belong to one of the groups of sizes mentioned hereinbefore and may be large bristles or small bristles.

Bristles having non-circular sections allow for improved circulation of air and of the liquid the brush is intended to apply.

Figure 17:
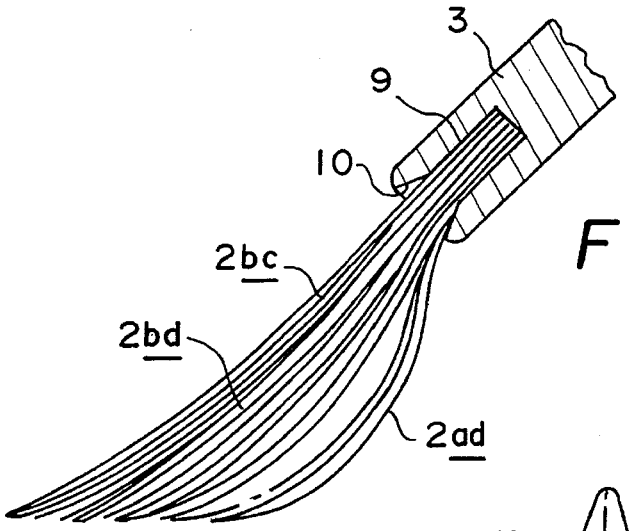
FIG. 17 is a diagrammatic elevation showing the behaviour of a brush according to FIG. 15 when varnish is applied, and finally.

FIG. 17, which is a diagram illustrating the application of varnish with the aid of the brush to a surface, inter alia, a nail, shows that the large bristles, such as 2*bc* have a smaller curvature very different from that of the small bristles, such as 2*ad* and that it is advantageous to add at least one group of bristles 2*bd* of intermediate section between that of the largest bristles 2*bc* and that of the smallest bristles 2*ad* to allow for the improved passage of air and to give more homogeneity to the flow of liquid, with greater control and greater ease of application of the product.

The housing 9 of the end of the shaft 3 of the brush in which the tuft of bristles is engaged and held advantageously opens towards the bottom via a truncated part flared towards the exterior 10 which eliminates, or at least reduces the stress on the bristles emerging from the shaft 3.

Figure 18:
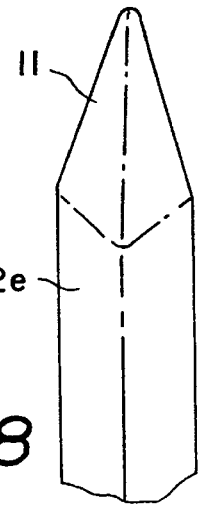
FIGS. 18 and 19 are diagrammatic perspective views showing the effect of abrasion on the tip of a bristle with a triangular section and a circular section respectively.
Figure 19:
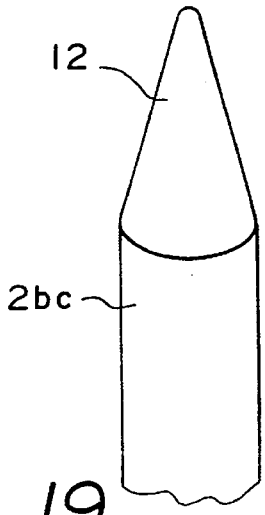

FIGS. 18 and 19 are perspective views showing the abrasion produced, inter alia, by a grinding wheel, at the end 11 of a bristle 2*e* with a triangular section (FIG. 18) and at the end 12 of a bristle 2*bc* with a circular section. It would appear that the abrasion is better on the bristle 2*e* whose end 11 subjected to abrasion is substantially in the shape of a pyramid, with edges, the tip of which is directed towards the exterior. The bristle 2*bc* with a circular section leads to a conical end 12.

The bristles 2*a*, 2*b* may be made of plastic, advantageously selected from the group formed by polyamides, polyesters, polyether block amides, polyethylene, polytetrafluoroethylene, polyvinylidene fluoride and polyacetates.

When the bristle is formed by a polyamide, polyamides 6, 6-6, 6-10, 6-12 or 11 can be used in particular.

An agent improving the sliding properties of the bristle and reducing its absorptivity with respect to water and/or solvent may be incorporated into these materials, in a proportion of between 0.2 and 15% by weight. The sliding agent is advantageously selected from the group formed by polytetrafluoroethylene, boron nitride and molybdenum disulphide.

The mixture of small bristles 2*a* and large bristles 2*b* with sections inscribed in circles of different diameters can be arranged in various ways, namely:

- bristles with sections inscribed in circles of different diameters, made of the same material;
- bristles with sections inscribed in circles of different diameters, made with the same cross-sectional shape;
- bristles with sections inscribed in circles of different diameters, made with different cross-sectional shapes;
- bristles with sections inscribed in circles of different diameters, made of different materials;
- bristles with different cross-sectional shapes, made of different materials.

The production of the brush according to the invention is of course not limited to the mixture of two different types of bristles. It is possible to use a mixture of three, four or five different types of bristles from among those mentioned hereinabove.

The brushes generally have between 100 and 600 bristles.

Embodiments of brushes according to the invention are given hereinafter.

Example 1: Brush with an apparent length of 18 mm p1 50% cylindrical bristles of polyamide 11 (known by the trade name RILSAN), 15/100 mm, loaded with 5% of molybdenum disulphide, approximately 54 bristles.

50% cylindrical bristles of polyamide 6–12 (known by the trade name Nylon TYNEX sold by DUPONT DE NEMOURS), 8/100 mm, the ends of the bristles being ground, approximately 230 bristles.

Example 2: Brush with an apparent length of 18 mm

10% cylindrical bristles of polyamide 11 (RILSAN), 15/100 mm, loaded with 5% of molybdenum disulphide, approximately 18 bristles.

90% cylindrical bristles of polyamide 6–12 (Nylon TYNEX), 8/100 mm, the ends of the bristles being ground, approximately 340 bristles.

Example 3: Brush with an apparent length of 18 mm

90% cylindrical bristles of polyamide 11 (RILSAN), 15/100 mm, loaded with 5% of molybdenum disulphide, approximately 110 bristles. P1 10% cylindrical bristles of polyamide 6–12 (Nylon TYNEX) 8/100 mm, approximately 46 bristles.

Example 4: Brush with an apparent length of 18 mm

50% cylindrical bristles with a capillary groove of polyamide 11(RILSAN), 17/100 mm, loaded with 5% of molybdenum disulphide, approximately 15 bristles.

50% cylindrical bristles of polyamide 6–12 (Nylon TYNEX), 8/100 mm, approximately 95 bristles.

Example 5: Brush with an apparent length of 17 mm

50% cylindrical bristles of polyamide 11 (RILSAN), 15/100 mm, loaded with 5% of molybdenum disulphide, approximately 54 bristles.

50% cylindrical bristles of polyamide 6–12 (Nylon TYNEX), 4/100 mm, ground ends, approximately 400 bristles.

Example 6: Brush with an apparent length of 16 mm

50% cylindrical bristles of polyamide 6–12 (Nylon TYNEX), 10/100 mm, approximately 180 bristles.

50% cylindrical bristles of polyamide 6–12 (Nylon TYNEX), 6/100 mm, approximately 320 bristles.

Example 7: Brush including three groups of bristles in equal proportions:

33.33% bristles with sections having a circumscribed circle with a diameter of 4/100 mm;

33.33% bristles with sections having a circumscribed circle with a diameter of 11/100 mm;

33.33% bristles with sections having a circumscribed circle with a diameter of 17/100 mm.

Example 8: Brush including four groups of bristles in equal proportions, i.e. 25% for each group: P1 the large bristles are formed by two groups of bristles with sections having a circumscribed circle with diameters of 10/100 mm and 8/100 mm respectively;

the small bristles are also formed by two groups of bristles with sections having a circumscribed circle with diameters of 6/100 mm and 4/100 mm respectively.

Figure 20:
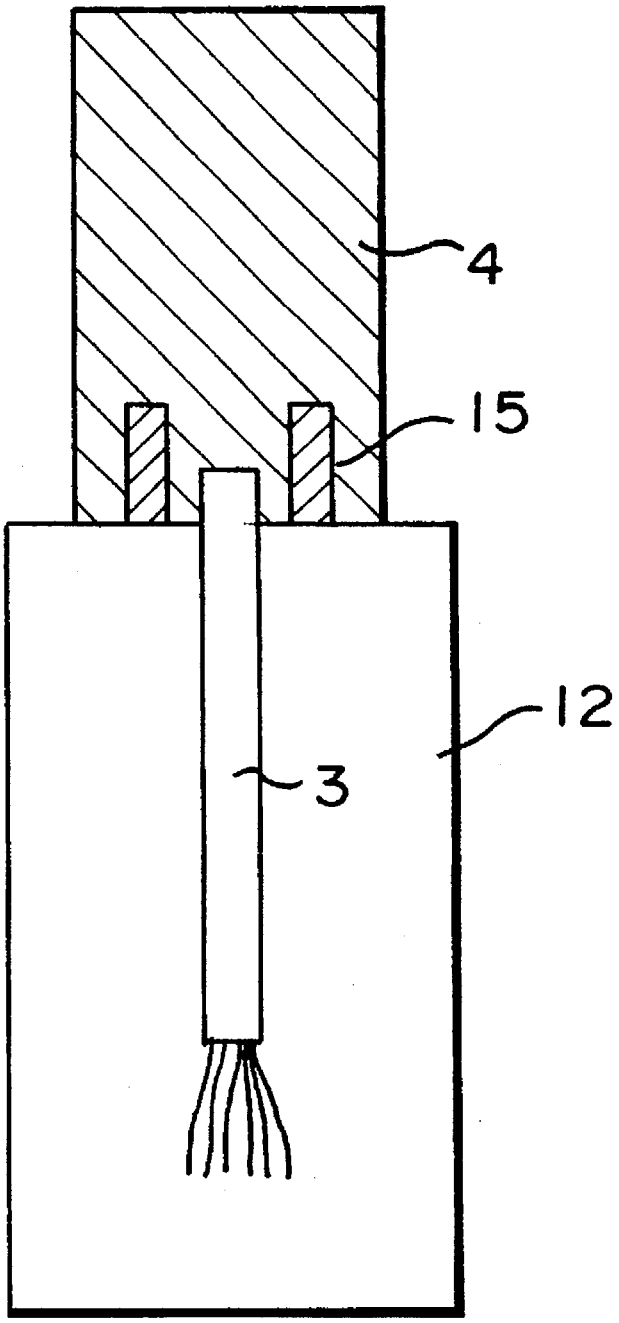
FIG. 20 shows a side view of the brush combined with a container.

FIG. 20 is a side view, partly in section, of the brush on a container 12 for the varnish with a treaded neck 15 on which the sleeve 4 is threaded.

By virtue of the bristles having a greater diameter, a brush according to the invention corresponds better in shape to the bulb of the nail and, as a result of the fact that it is not too soft, it allows for a pressure considerably increasing the precision of application.

The results of tests have proved surprising. Extreme ease of use, great precision and a marked increase in coverage and autonomy are noted with a brush according to the invention by virtue of the storage effect as a result of the large bristles.

The section of the bristles may have any shape and numerous materials are possible for the bristles, preferably different nylon materials. When a bristle does not have a circular section, the diameter to be considered to characterise this section, as explained hereinbefore, is the diameter of the circle circumscribed about the section.

What is claimed is:

1. Brush for the application of nail coating or similar product, comprising bristles disposed substantially parallel to one another in a tuft and fixed to a support with said tuft having a selected length, said bristles comprising a mixture of bristles of small cross section and bristles having a larger cross section than said small cross section, the proportion of larger bristles being between 2% and 95% by volume in relation to the total volume of the tuft of the brush, said large bristles further comprising at least two subgroups of bristles with cross sections of different sizes, said larger cross section bristles providing a means to increase the length of said tuft for more effective application of the nail coating product, the sizes of the cross section of the large bristles within a single group being substantially constant, said bristles of small cross section including at least two subgroups of bristles with cross sections of different sizes, the sizes of the cross sections of the small bristles of a single sub group being substantially constant.

2. Brush according to claim 1, characterised in that the proportion of large bristles is between 10% and 90% by volume in relation to the total volume of the tuft (T) of the brush.

3. Brush according to claim 1 or claim 2, characterised in that the small bristles have a cross section inscribed in a circle having a diameter of between 4 hundredths and 10 hundredths of a millimeter, while the large bristles have a section inscribed in a circle having a diameter of between 10 hundredths and 40 hundredths of a millimeter.

4. Brush according to claim 3, characterised in that the small bristles include at least two groups of bristles with cross sections of different sizes, the sizes of the sections of the small bristles of one single group being substantially constant.

5. Brush according to claim 3, characterised in that the cross section of the larger bristles is inscribed in a circle having a diameter of between 14 hundredths and 17 hundredths of a millimeter.

6. Brush according to claim 1 or claim 2, characterised in that a difference between the diameters of the circles circumscribed about the sections of two groups of bristles with cross sections of different sizes is at least 2 hundredths of a millimeter.

7. Brush according to claim 1 or claim 2, characterised in that the length of the tuft of bristles is between 13 and 20 mm.

8. Brush according to claim 1 or claim 2, in which the bristles are made of plastic material, characterised in that the plastic material forming the bristles is selected from the group formed by polyamides, polyesters, polyether block amides, polyethylene, polytetrafluoroethylene, polyvinylidene fluoride and polyacetals.

9. Brush according to claim 8, in which the bristles comprise a polyamide, characterised in that the polyamide is selected from the group of polyamides 6, 6-6, 6-10, 6-12 or 11.

10. Brush according to claim 1 or claim 2 for the application of a nail varnish or a similar product having a low viscosity corresponding to a liquid formulation, characterised in that the mixture of bristles includes approximately 90 to 95% by volume of larger bristles in the tuft.

11. Brush according to claim 1 or claim 2, in which the bristles are made of natural material, characterised in that the material forming the bristles is a natural silk.

12. Brush according to claim 1 or claim 2, characterised in that at least some of the bristles have slight undulations over their length.

13. Brush according to claim 1 or claim 2, characterised in that the bristles have sections the shape of which is selected from the group of shapes consisting of circular, polygonal, cross-shaped, annular, flat or U-shaped.

14. Brush according to claim 1 or claim 2, characterised in that the cross section of the brush is flat.

15. A container comprising a bottle of varnish with a neck and a cylindrical sleeve, a brush for the application of the varnish comprising bristles disposed substantially parallel to one another in a tuft and fixed to a support, said brush being receivable in said bottle, said bristles comprising a mixture of bristles of small cross section and bristles having a larger cross section than said small cross section, the proportion of larger bristles being between 2% and 95% by volume in relation to the total volume of the tuft of the brush, said larger bristles comprising at least two subgroups of bristles with cross sections of different sizes, the sizes of said cross sections of the bristles in one subgroup of said larger bristles being substantially constant.

16. A container as claimed in claim 15 wherein said small bristles include at least two subgroups of bristles with cross sections of different sizes, the sizes of the cross sections of small bristles of one subgroup being substantially constant.

17. Brush according to claim 16 characterised in that the sliding agent is selected from the group formed by polytetrafluoroethylene, boron nitride and molybdenum disulphide.

18. The brush as claimed in claim 1 wherein the size of the cross sections of the larger bristles within a said sub- group are substantially constant.

19. The brush as claimed in claims 1 or 2 wherein the cross section of the brush is circular.

20. The brush as claimed in claims 1 of 2 wherein the cross section of the brush is in the shape of a semicircle.

21. Brush for the application of nail varnish or a similar product comprising bristles disposed substantially parallel to one another in a tuft and fixed to a support, said bristles being formed by a mixture of bristles of small cross section and bristles having a larger cross section than said small cross section, the proportion of larger bristles being between 2% and 95% by volume in relation to the total volume of the tuft of the brush, said larger bristles including at least two subgroups of bristles with cross sections of different sizes, the sizes of the cross sections of the larger bristles within one subgroup being substantially constant, at least some of said bristles of said brush including an agent for improving the sliding properties of the bristles and reducing the absorptivity of the bristles with respect to water, said agent being in a proportion of between 0.2% and 15% by weight.

* * * * *